US007874628B2

(12) United States Patent
Maier-Hunke

(10) Patent No.: US 7,874,628 B2
(45) Date of Patent: Jan. 25, 2011

(54) BOXES FOR KEYS

(75) Inventor: Horst-Werner Maier-Hunke, Iserlohn (DE)

(73) Assignee: "Durable" Hunke & Jochheim GmbH & Co. KG, Iserlohn (DE)

( * ) Notice: Subject to any disclaimer, the term of this patent is extended or adjusted under 35 U.S.C. 154(b) by 972 days.

(21) Appl. No.: 10/565,475

(22) PCT Filed: Sep. 3, 2004

(86) PCT No.: PCT/EP2004/009976

§ 371 (c)(1),
(2), (4) Date: Jan. 20, 2006

(87) PCT Pub. No.: WO2005/023065

PCT Pub. Date: Mar. 17, 2005

(65) Prior Publication Data

US 2006/0207953 A1 Sep. 21, 2006

(30) Foreign Application Priority Data

Sep. 4, 2003 (DE) ..... 103 41 494

(51) Int. Cl.
*A47B 45/00* (2006.01)

(52) U.S. Cl. ..... 312/257.1; 211/85.9

(58) Field of Classification Search ..... 312/257.1, 312/262, 263, 265.5, 326, 329; 40/657; 211/85.9, 211/70.1; 206/37.1, 37.4, 37.6, 37.7, 37.8
See application file for complete search history.

(56) References Cited

U.S. PATENT DOCUMENTS 1,978,494 A * 10/1934 Junkers ..... 52/578
2,483,606 A * 10/1949 Albach et al. ..... 312/257.1
2,728,624 A * 12/1955 Caruso ..... 312/262
3,070,235 A * 12/1962 Manzardo ..... 211/85.9
3,754,806 A * 8/1973 Nakagawa ..... 312/265.5
3,813,138 A * 5/1974 Doohan ..... 312/309
4,125,304 A * 11/1978 Ebert ..... 312/257.1
5,076,454 A * 12/1991 Garton et al. ..... 220/1.5
5,411,139 A * 5/1995 Victory ..... 206/493
5,451,102 A * 9/1995 Chuan ..... 312/263
5,690,212 A * 11/1997 Huang Hsu ..... 206/37.8
5,695,263 A * 12/1997 Simon et al. ..... 312/265.4
5,921,646 A * 7/1999 Hwang ..... 312/263
5,975,660 A * 11/1999 Tisbo et al. ..... 312/263
6,422,671 B1 * 7/2002 Lodge et al. ..... 312/245
6,474,759 B2 * 11/2002 Hsu ..... 312/263

FOREIGN PATENT DOCUMENTS

| | | |
|---|---|---|
| CH | 272795 | 1/1951 |
| FR | 1164566 | 10/1958 |
| GB | 890914 | 3/1962 |

* cited by examiner

*Primary Examiner*—James O Hansen
(74) *Attorney, Agent, or Firm*—Mark P. Stone

(57) ABSTRACT

The aim of the invention is to provide boxes for keys that can be produced at low costs, especially when they form an integral part of a series of boxes of different capacities. For this purpose, the housing of such a box is configured with side walls (7, 8) screwed together with an upper part (1) and a lower part (2) and a back wall (22 22) guided in a guide groove (18, 19) of the side walls (7, 8). The side walls (7, 8) and the door (13) of the housing are preferably constituted of continuous profiled elements cut to shape and the back wall (22, 22) as well as the upper and lower parts (1, 2) consist of diecast elements. The back wall is provided with perforations (24) for hanging at least one key rail (25).

20 Claims, 1 Drawing Sheet

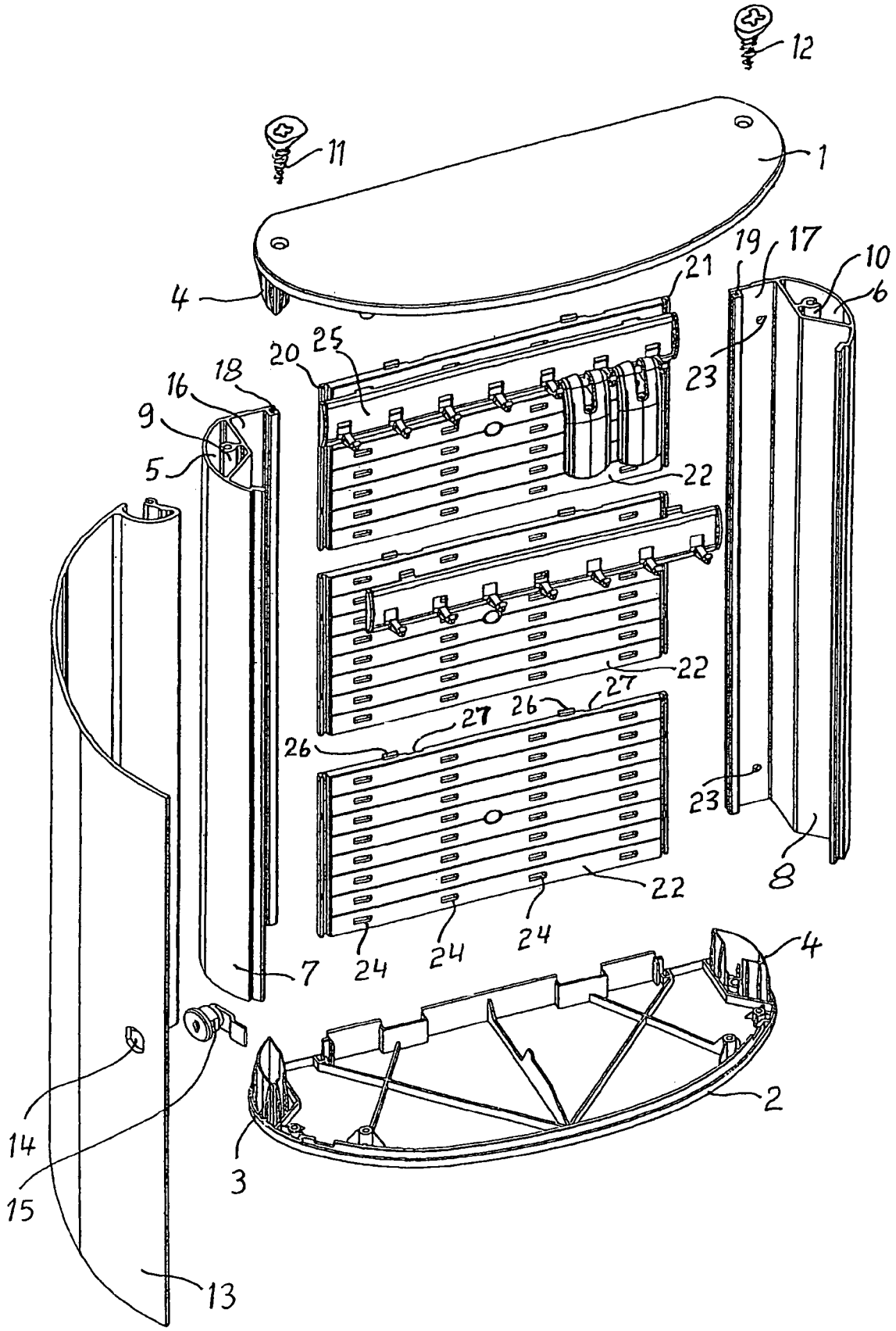
12
11
1
4
21
19
17
10
6
20
25
23
18
16
9
5
22
22
27
26
27
26
23
8
22
24
24
24
7
4
2
14
15
3
13

BOXES FOR KEYS

TECHNICAL FIELD

The invention relates to a key box having a metal or plastics housing which can be closed by a door.

PRIOR ART

Key boxes of the above type are known, the housings of which are made from blanks or deep-drawn parts individually tailored to the size of the respective key box (SCHÄFER SHOP Main Catalog 2003/2004, pp. 868, 869). The tool and/or production cost necessary for the production of such key boxes is undesirably high, especially in cases in which a manufacturer offers a range of key boxes which have sizes matched to different holding capacities.

REPRESENTATION OF THE INVENTION

The object of the invention is to provide a key box, the structure of which allows a significantly more economical production compared to known production methods. This object is achieved according to the invention by the fact that the housing has two side walls, screwed together with a top part and a bottom part, and a rear wall guided in guide grooves in the side walls.

The division of the housing into a plurality of joinable single parts not only simplifies the production of the single parts, but also allows certain identical parts to be used to construct different-sized key boxes, in which case it proves particularly advantageous if the side walls and the doors consist of cut-to-length continuous profiles and the rear walls consist of a plurality of segments disposed one above the other.

Further features and details of the invention emerge from the subclaims and the following description of an embodiment of a key box represented in the appended drawing.

WAYS OF IMPLEMENTING THE INVENTION

In the single FIGURE, 1 and 2 are the top part and the identically configured bottom part of a key cabinet. The two aforementioned parts have guide lugs 3 and 4, which can be inserted in cavities 5, 6 in two likewise identically configured side walls 7, 8. The side walls 7, 8 are constituted by cut-to-length continuous profiles, which are preferably configured as aluminum extruded profiles. Jutting into the cavities 5, 6 are hollow-profile webs 9, 10, the ends of which are used to receive screws 11, 12 which serve to connect the side walls 7, 8 to the top part 1 and the bottom part 2.

In the same way as the side walls 7, 8, the door 13 consists of a cut-to-length continuous profile, which is provided with an opening 14 for the reception of a lock 15.

The side walls 7, 8 have flanges 16, 17, whose ends facing away from the cavities 5, 6 and containing guide grooves 18, 19 serve to receive webs 20, 21 located on opposite sides of segments 22 which make up the rear wall of the key box. As illustrated in the drawing, the grooves 18, 19 of the side walls 7, 8 will be engaged behind the webs 20, 21. In addition, the flanges 16, 17 are provided with bores 23 which enable the key box to be fastened to a wall. The flanges 16, 17 constitute, in other words, guide and fastening flanges.

The segments 22 which are used to make the rear wall of the key box are preferably configured as plastics injection-molded parts. They have a plurality of rows of rectangular perforations 24, of which the perforations of the outer perforation rows can be used to fasten key rails 25. Studs 26 and recesses 27 on the upper and lower edges of the segments 22, together with the guide grooves 18, 19 in the flanges 16, 17, ensure that the segments 22 are held together to form a rigid rear wall. The segmentation of the rear wall, like the use of cut-to-length continuous profiles and identical top and bottom parts, has a positive effect upon the economy of production of different-sized key boxes.

As illustrated by the drawing, the key rails 25 are directly and removably mounted to the rectangular perforations 24 in the segments 22 forming the rear wall so that the key rails are non-movably mounted at fixed positions on the rear wall when the key box is in an assembled configuration. The top and bottom edges of the segments 22 are substantially planar so as to form a continuous rear wall when the segments 22 are stacked atop one and other.

The invention claimed is:

1. A key box having a door (13) and a metal and/or plastic housing which can be closed by the door (13), the housing comprising a rear wall (22, 22) and side walls (7, 8), the rear wall (22, 22) of the housing being provided with means for hanging keys supported directly by said rear wall, wherein the side walls (7, 8) and the door (13) consist of cut-to-length extruded profiles which, in the region of the edges of the side walls (7, 8) facing away from the door (13), have vertically running guide grooves (18, 19) for receiving the rear wall (22, 22), the side walls (7, 8) being attached to a bottom part (2) forming the floor of the box and a top part (1) forming the roof of the box and comprising cavities (5, 6) and hollow-profile webs (9, 10) jutting into the cavities (5, 6), the ends of the hollow-profile webs being configured to receive screws (11, 12) for connecting the side walls (7, 8) to the top part (1) and the bottom part (2).

2. The key box as claimed in claim 1, characterized in that the side walls (7, 8) are configured partially as hollow profiles.

3. The key box as claimed in claim 2, characterized in that the side walls (7, 8) and the door (13) are configured as aluminum extruded profiles.

4. The key box as claimed in claim 2, characterized in that the top part (1) and the bottom part (2) are configured as plastic injection-molded parts.

5. The key box as claimed in claim 2, characterized in that the side walls (7, 8) have flanges (16, 17) forming parts of the rear wall.

6. The key box as claimed in claim 2, characterized in that the top part (1) and the bottom part (2) of the housing are identically configured.

7. The key box as claimed in claim 2, characterized in that the side walls (7, 8) of the housing are identically configured.

8. The key box as claimed in claim 1, characterized in that the side walls (7, 8) and the door (13) are configured as aluminum extruded profiles.

9. The key box as claimed in claim 1, characterized in that the top part (1) and the bottom part (2) are configured as plastic injection-molded parts.

10. The key box as claimed in claim 1, characterized in that the side walls (7, 8) have flanges (16, 17) forming parts of the rear wall.

11. The key box as claimed in claim 10, characterized in that the rear wall consists of a plurality of segments disposed one above the other, and the flanges (16, 17) of the side walls (7, 8) are configured as guide flanges for the segments (22-22) and as fastening flanges for the key box.

12. The key box as claimed in claim 1, characterized in that the means for hanging keys are formed by at least one key rail (25), which can be hung in perforations (24) in the rear wall (22-22).

13. The key box as claimed in claim 1, characterized in that the top part (1) and the bottom part (2) of the housing are identically configured.

14. The key box as claimed in claim 1, characterized in that the side walls (7, 8) of the housing are identically configured.

15. The key box as claimed in claim 1, characterized in that the rear wall comprises a plurality of segments (22) disposed one above the other.

16. A key box having a door (13) and a metal and/or plastic housing which can be closed by the door (13), the housing comprising a continuous rear wall (22) and side walls (7, 8), the rear wall (22) of the housing comprising a plurality of segments (22) disposed one above the other being provided with means for hanging keys supported directly by said rear wall, said plurality of segments having substantially planar top and bottom edges for forming said continuous rear wall, wherein the side walls (7, 8) and the door (13) comprise cut-to-length continuous profiles which, in the region of the edges of the side walls (7, 8) facing away from the door (13), have vertically running guide grooves (18, 19) for receiving the rear wall (22), the segments (22) having studs (26) and recesses (27) on the upper and lower edges of the segments (22) configured to form together with the guide grooves (18, 19) a rigid rear wall (22), the side walls (7, 8) being attached to a bottom part (2) forming the floor of the box and a top part (1) forming the roof of the box, the top part (1) and the bottom part (2) being provided with guide lugs (3, 4), which jut into cavities (5, 6) in the side walls (7, 8), the side walls (7, 8) comprising cavities (5, 6) and hollow-profile webs (9, 10) jutting into the cavities (5, 6), the ends of the hollow-profile webs being configured to receive screws (11, 12) for connecting the side walls (7, 8) to the top part (1) and the bottom part (2).

17. The key box as claimed in claim 16, characterized in that the segments (22) of the rear wall are configured as plastic injection-molded parts.

18. The key box as claimed in claim 17, characterized in that the side walls (7, 8) have flanges (16, 17) forming parts of the rear wall, and that the flanges (16, 17) of the side walls (7, 8) are configured as guide flanges for the segments (22-22) and as fastening flanges for the key box.

19. The key box as claimed in claim 16, characterized in that the side walls (7, 8) have flanges (16, 17) forming parts of the rear wall, and that the flanges (16, 17) of the side walls (7, 8) are configured as guide flanges for the segments (22-22) and as fastening flanges for the key box.

20. A key box having a door (13) and a metal and/or plastic housing which can be closed by the door (13), the housing comprising a rear wall (22, 22) and side walls (7, 8), the rear wall (22, 22) of the housing being provided with means for hanging keys supported directly by said rear wall, said means for hanging keys being fixedly mounted to said rear wall in the assembled operating configuration of the key box but being removable from said rear wall, wherein the side walls (7, 8) and the door (13) comprise cut-to-length continuous profiles which, in the region of the edges of the side walls (7, 8) facing away from the door (13), have vertically running guide grooves (18, 19) for receiving webs (20, 21) of the rear wall (22, 22), the guide grooves (18, 19) being engaged behind the webs (20, 21), the side walls (7, 8) being attached to a bottom part (2) forming the floor of the box and a top part (1) forming the roof of the box and comprising cavities (5, 6) and hollow-profile webs (9, 10) jutting into the cavities (5, 6), the ends of the hollow-profile webs being configured to receive screws (11, 12) for connecting the side walls (7, 8) to the top part (1) and the bottom part (2).

* * * * *